United States Patent [19]

Rowlands

[11] 4,146,008

[45] Mar. 27, 1979

[54] TARGET POSITIONER FOR SKEET TRAP

[75] Inventor: Kenneth C. Rowlands, Utica, N.Y.

[73] Assignee: Remington Arms Company, Inc., Bridgeport, Conn.

[21] Appl. No.: 817,515

[22] Filed: Jul. 21, 1977

[51] Int. Cl.[2] ..... F41F 9/00

[52] U.S. Cl. ..... 124/43; 124/8

[58] Field of Search ..... 124/8, 9, 41 R, 43, 124/36

[56] References Cited

U.S. PATENT DOCUMENTS

| | | | |
|---|---|---|---|
| 834,211 | 10/1906 | Linderman | 124/43 |
| 2,996,058 | 8/1961 | Ervine | 124/8 |
| 3,937,204 | 2/1976 | Alday et al. | 124/9 |

*Primary Examiner*—Richard C. Pinkham
*Assistant Examiner*—William R. Browne
*Attorney, Agent, or Firm*—Nicholas Skovran; William L. Ericson

[57] ABSTRACT

A target positioner for an autoloading target throwing machine. The positioner can be adjustably mounted on the rotatable throwing arm and is used with a resilient target nest, whose function is to locate the target to be thrown in the proper position on a launch platform. Camming surfaces on the positioner act to force the target into proper position in the resilient target nest upon cocking of the throwing arm.

6 Claims, 4 Drawing Figures

TARGET POSITIONER FOR SKEET TRAP

This invention relates to an improvement to autoloading target throwing machines, i.e. where targets can be thrown repeatedly merely by pushing a button—as long as targets remain in the magazine. More specifically, the invention relates to a target positioner for positioning the target at a predetermined point on the launch platform in order to project the target in a consistent and accurate direction.

Another object of the invention is the provision of an economic and easily adjusted cam member that cooperates with a flexible target nest to position the target accurately on the launch platform before throwing.

Further objects will be apparent from a consideration of the following description and accompanying drawings wherein.

Unlike trap shooting where the angular flight of the targets is deliberately made unpredictable and variable, skeet shooting demands that the direction of flight of the targets be constant for each one thrown. It is well known that to achieve this consistency of flight, the targets must all start out at exactly the same point on the throwing arm. Any variation, either toward or away from the center line of rotation of the throwing arm, will cause the targets to leave the arm at a slightly different time or in a different angular relationship and thus fly in different directions.

The present invention is an improvement to the trap shown in U.S. Pat. No. 3,937,204, issued Feb. 10, 1976 and divisions thereof including U.S. Pat. No. 4,005,695, issued Feb. 1, 1977, Application Ser. No. 657,884 filed Feb. 13, 1976, and Application Ser. No. 742,649 filed Nov. 17, 1976, all assigned to the Assignee of the present invention. The operation of the trap is explained in detail in the patents and pending applications cited above and will be mentioned herein only if and when it applies to the target positioner. Obviously, the invention can be used for other traps other than the traps shown in the patents and applications cited above.

It was noted that especially in the "High House" installation (the left house in a skeet field where the trap is elevated about 9½ feet from the ground), where the launch platform is not inclined very steeply, the momentum of the target sliding down the platform is not always sufficient to carry it into the apex of the "V" of the flexible target nest.

Figure 4:
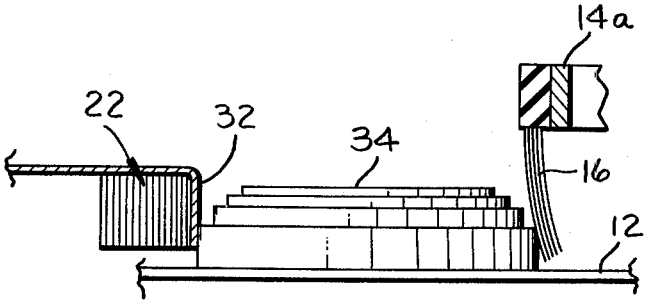
FIG. 4 shows a cross-sectional view taken on Line 4—4 of FIG. 3.

All target throwing machines employ some kind of target positioner, stop, or locator. Representative positioners etc. are shown in U.S. Pat. No. 1,499,845, issued on July 1, 1924 to W. I. Spangler; No. 2,989,045, issued on June 20, 1961 to W. D. Hodge et al; No. 2,996,058, issued on Aug. 15, 1961 to A. W. G. Ervine; No. 3,826,238, issued on July 30, 1974 to I. S. Hansen; and No. 3,937,203, issued on Feb. 10, 1976 to E. Riedmueller et al. Hansen is interesting because of its brush 56 (FIG. 4).

Figure 1:
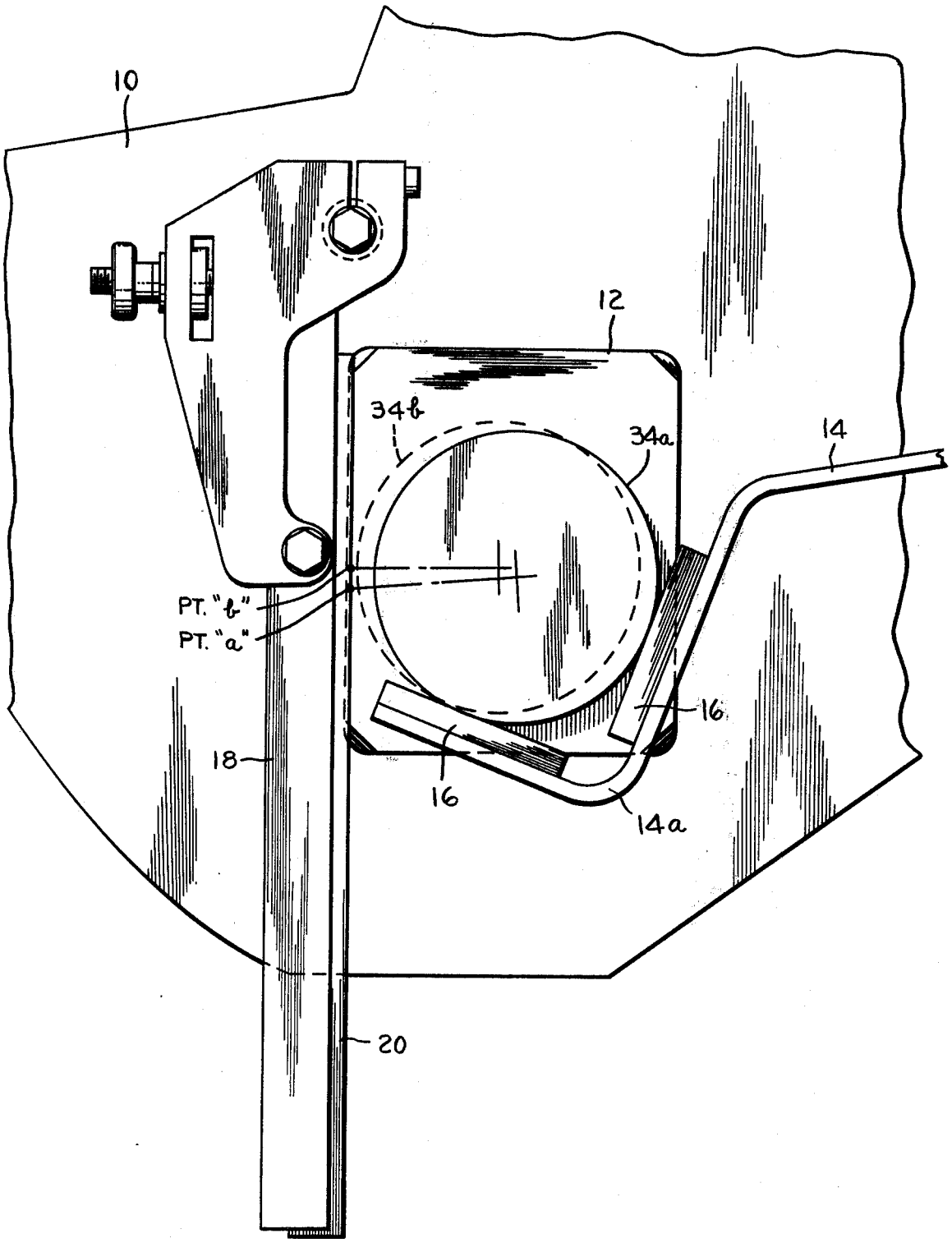
FIG. 1 shows a plan view of a portion of a target throwing trap showing a cocked throwing arm and a prior art V-shaped flexible target nest with two possible variations of targets dropped onto the launch platform, one in the correct position and the other in an incorrect position.

FIG. 1 shows a launch platform 10, which, although not shown in the drawings, is mounted in a conventional manner so as to be inclined on a base or frame. A drop pad 12 is mounted flush with said platform in the area where the targets drop from the magazine, positioned above (not shown). Pad 12 is cushioned to prevent excessive bounce and to avoid target breakage. Adjustably mounted on and spaced from said platform 10 is a target nest arm 14 having a V-shaped free end **14*a* with brushes 16 extending downwardly toward the platform. The brushes 16 keep the target from sliding off the drop pad 12 and locates the target in the correct throwing position on the platform while allowing the target throwing arm 18** to sweep through and pick up the target without interference.

Throwing arm 18 is mounted on the base to rotate a full 360°, as explained in U.S. Pat. No. 3,937,204, cited above. A target guide rail 20, preferably made of an elastomeric or other resilient material, is attached to the leading edge of the throwing arm to provide the necessary friction and cushioning required to throw targets.

Figure 2:
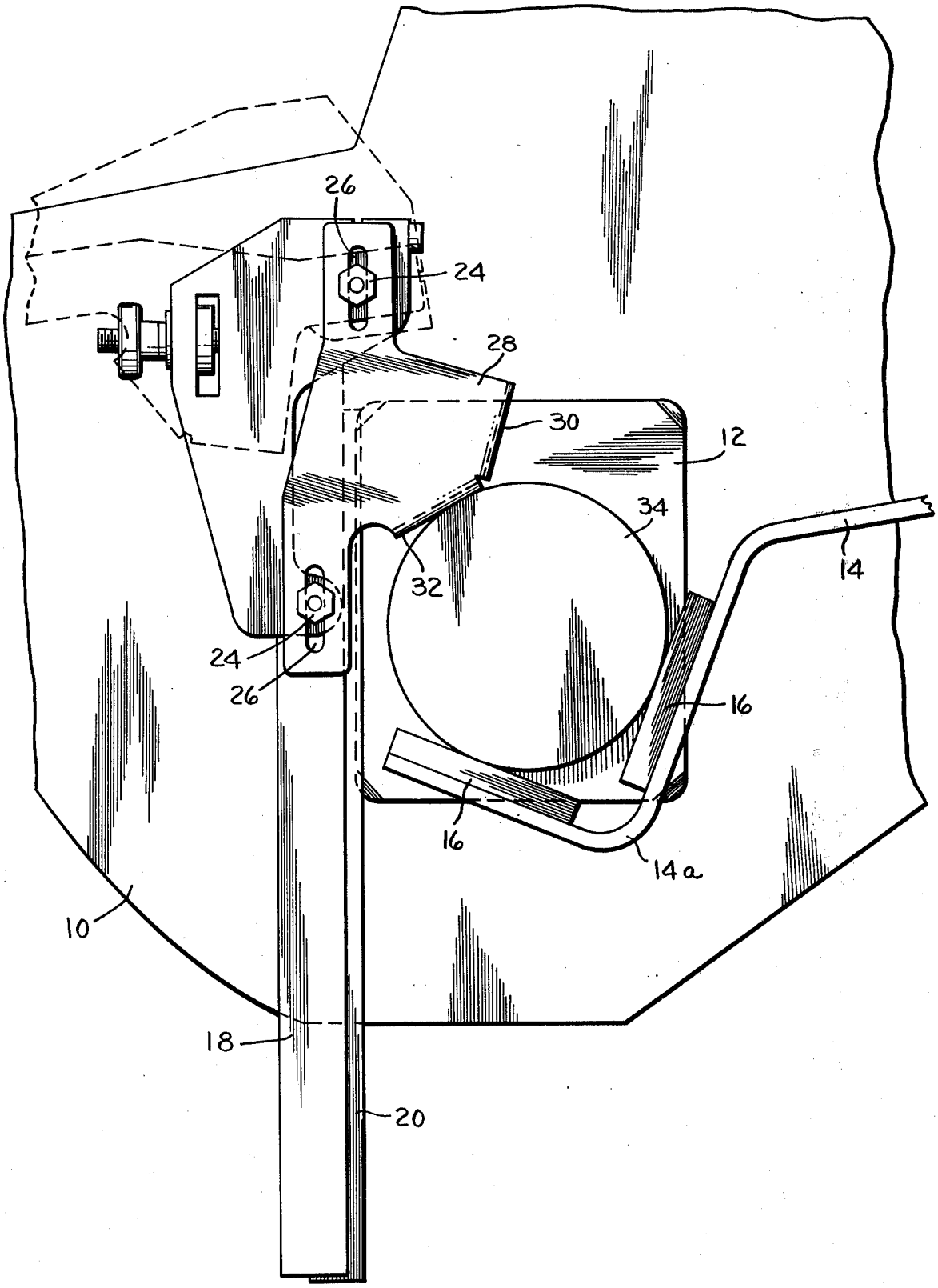
FIG. 2 shows a plan view of a portion of a target throwing trap showing a cocked throwing arm including the improved target positioner and a V-shaped, flexible target nest with the target in the proper position before firing of the trap.

A target positioner 22 is adjustably mounted at the rear end of the throwing arm 18 by means of screws 24 and adjustment slots 26. The positioner 22 has a transverse portion 28 on which are formed two camming surfaces 30 and 32 (see FIG. 2).

Referring back to FIG. 1, it will be seen that a target **34*a* is shown in solid line and a target 34*b* is shown in dotted line. Target 34*a* has slid into the correct position in the apex of the target nest "V." The initial contact point between target 34*a* and the target guide rail 20, when the throwing arm starts to rotate through on its throwing cycle, is point "a." Target 34*b* did not have enough momentum to carry it into the apex of the "V" and is hung up to one side. Here the initial contact point between the target 34*b* and the guide rail is point "b." Therefore, upon firing of the trap, target 34*b* would start off closer to the center line of rotation of the throwing arm and would have a greater distance to travel to the end of the throwing arm. The target 34*b* would thus be carried around further and fly to the left of the trajectory of target 34*a***.

The positioner 22 is intended to consistently locate the target in the apex of the "V" of the target nest brushes 16.

Figure 3:
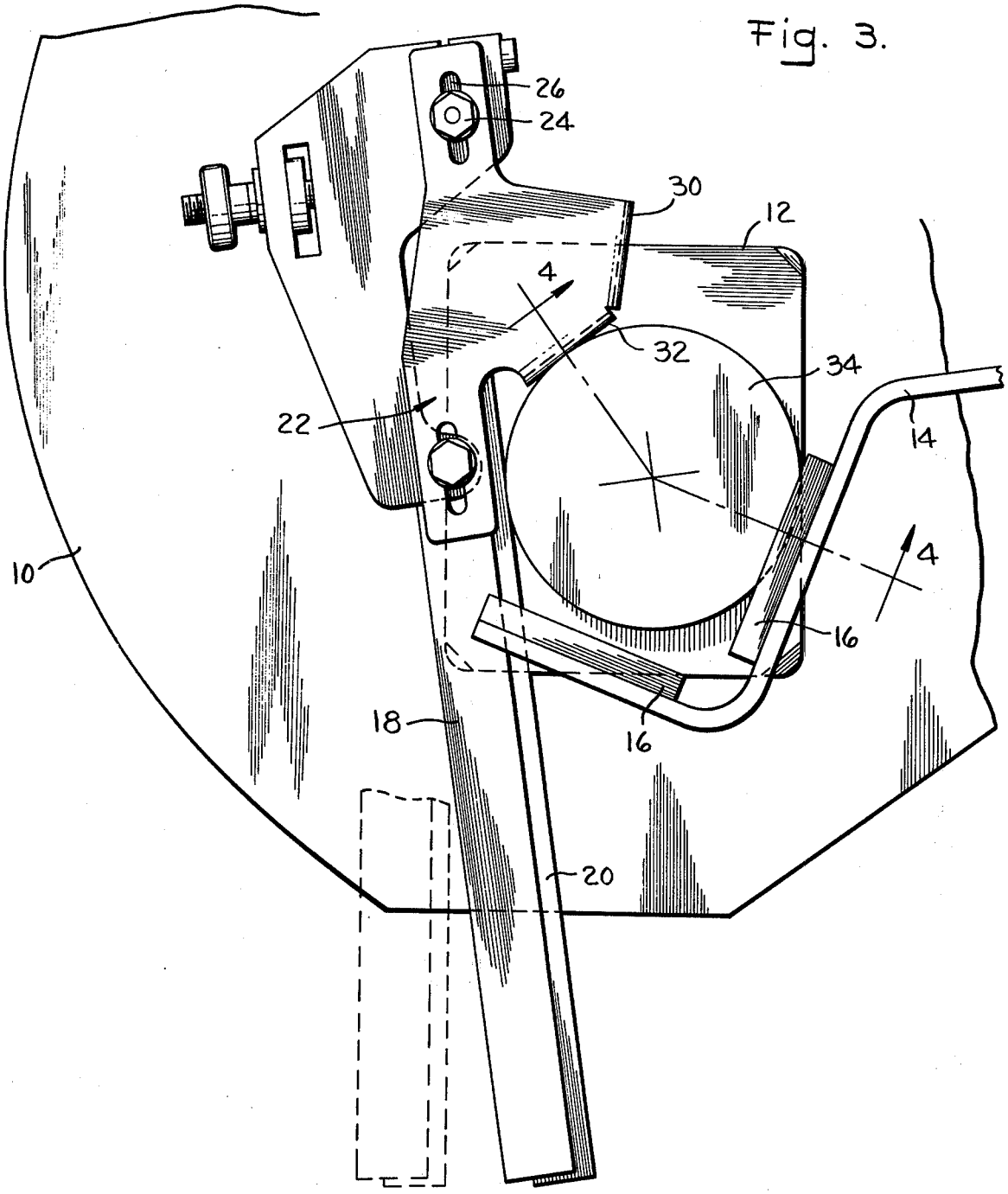
FIG. 3 shows a plan view of a portion of a trap showing the throwing arm beginning to fire through the flexible target nest and the target forced into a "V" locator formed by the target positioner and the target guide rail.

As the throwing arm rotates into the cocked position (shown in FIG. 2 and in dotted lines in FIG. 3), the target positioner 22, attached to the arm, and specifically camming surfaces 30 and 32 causes a target 34, that has previously been deposited onto the launch platform 10 ahead of the throwing arm, to be cammed into the apex of the "V" formed by the target nest brushes 16. The target positioner is adjustable fore and aft on the arm by screw and slot means 24 and 26, thereby enabling it to be fixed in such a position that the target can be forced into the brushes, depressing the bristles slightly (FIG. 4) and completely trapping the target at three points around its circumference (see FIG. 2), thereby ensuring consistent initial location in the target nest.

The camming surface 32 of the target positioner, when coupled with the leading edge of the target guide rail 20, also forms a "V" locator which acts as rear location for the target once the throwing arm starts to rotate through on its target throwing cycle (see FIG. 3), the target being forced into this position by the resistence of the right hand target nest brush, thus ensuring that the target starts out at exactly the same point on the throwing arm target guide rail each time.

What is claimed is:

1. A target positioner for a target throwing machine having a stationary launch platform, means for dispensing a target to said platform, a throwing arm, means mounting said throwing arm for rotational movement relative to said stationary platform for propelling said target from said platform, a target nest mounted on said platform for locating the target on the platform prior to being thrown, said target positioner comprising a cam means on said throwing arm, said cam means, upon rotation of said arm into the cocked position, acting to move said target into the target nest to the proper starting position on said platform.

2. A target positioner as recited in claim 1 wherein said cam means comprises a separate cam member adjustably mounted on said throwing arm, and camming surfaces on said cam member.

3. A target positioner as recited in claim 1 wherein said target nest comprises a V-shaped member vertically spaced from said launch platform and having resilient brushes extending downwardly toward said platform, said cam means being adjustable on said arm to enable it to be fixed in position to force the target into the brushes to depress the bristles slightly and completely trap the target at three points around its circumference to ensure consistent initial location in the target nest.

4. In an autoloading target throwing machine having a target throwing apparatus and a magazine for serially feeding targets to said apparatus, a stationary launch platform on said apparatus on which said targets are deposited, a throwing arm, means mounting said throwing arm for rotational movement relative to said stationary platform for propelling said targets from said platform, a resilient target nest mounted on said platform forwardly of said throwing arm for locating said targets prior to being propelled by the throwing arm, said propelled targets moving through the target nest during its throwing cycle, a target positioner on said throwing arm having camming surfaces thereon which engage a target during the throwing arm cocking cycle to move the target forwardly into the target nest and support the target in its desired position prior to being propelled from the platform.

5. In an autoloading target throwing machine as recited in claim 4, said target positioner comprising a cam member adjustably mounted on said throwing arm, said camming surfaces being located on said cam member so as to force the target into said resilient target nest during the throwing arm cocking cycle in order to ensure consistent initial location in the target nest.

6. In an autoloading target throwing machine as recited in claim 4 wherein said throwing arm comprises a target guide rail that engages the target during the throwing cycle, said target positioner comprising a cam member, means adjustably mounting said cam member on said throwing arm, said cam member having a portion extending forwardly and transversely of the longitudinal axis of said throwing arm, said camming surfaces being located on said transverse cam member portion in offset and angular relationship to said throwing arm, one of said camming surfaces cooperating with said target guide rail to form a "V" locator which acts as the rear location for the target once the throwing arm starts to rotate on its target throwing cycle.

* * * * *